United States Patent [19]

Komesker et al.

[11] Patent Number: 4,532,667

[45] Date of Patent: Aug. 6, 1985

[54] FLOOR CLEANING DEVICE HAVING A REPLACEABLE BRUSH ASSEMBLY

[75] Inventors: Heinrich Komesker, Wuppertal; Ludger Helmes, Velbert, both of Fed. Rep. of Germany

[73] Assignee: Vorwerk & Co. Interholding GmbH, Wuppertal, Fed. Rep. of Germany

[21] Appl. No.: 634,401

[22] Filed: Jul. 25, 1984

[30] Foreign Application Priority Data

Sep. 10, 1983 [DE] Fed. Rep. of Germany ..... 3332743

[51] Int. Cl.[3] ..... A47L 11/18

[52] U.S. Cl. ..... 15/49 C; 15/390; 192/56 R

[58] Field of Search ..... 15/41 R, 49 C, 50 C, 15/52, 98, 383, 384, 390; 192/56 R, 56 C, 56 L, 30 W

[56] References Cited

U.S. PATENT DOCUMENTS 4,235,321 11/1980 Stein ..... 15/390 X 4,317,253 3/1982 Gut ..... 15/390

*Primary Examiner*—Edward L. Roberts

*Attorney, Agent, or Firm*—Walter Ottesen

[57] ABSTRACT

The invention is directed to a replaceable brush assembly for a floor cleaning device such as an electric carpet sweeper. The cleaning device is equipped with a so-called central drive. Replaceable brush assemblies are pushed over respective ends of the output shaft. Each brush assembly is equipped with a tubular brush having a ring-shaped cavity disposed in surrounding relationship to a slot formed in the end face of the output shaft. An S-shaped spring has two arms connected to each other by a straight segment which seats in the slot of the shaft when the brush assembly is mounted on the shaft. The arms are resiliently biased against the wall of the ring-shaped cavity.

8 Claims, 2 Drawing Figures

5
12
16
7
18
23
22
14
19
21
10
20
15
17
11
12

2
3
4
6
5
8
7
12
II
II
10
11
9
13
1

FLOOR CLEANING DEVICE HAVING A REPLACEABLE BRUSH ASSEMBLY

FIELD OF THE INVENTION

The invention relates to a floor cleaning device such as an electric floor sweeper having a replaceable brush assembly equipped with a coupling. The floor sweeping device has a so-called central drive and the brushes are driven by a shaft running freely within the brushes. The brushes can be pulled off of the shafts and replaced.

BACKGROUND OF THE INVENTION

In electric carpet sweepers with a central drive, a drive wheel is arranged in the mid portion of the channel for accommodating the brushes. Cantilevered shaft portions extend to the left and right of the drive wheel and carry respective brushes as disclosed, for example, in British Patent No. 842,668. If the drive wheel is driven by a flat belt as disclosed in British Patent No. 842,668, the flat belt is deliberately used as a type of coupling since the belt slips when a brush is blocked thereby preventing the motor from becoming destroyed. However, if a toothed belt is utilized in lieu of a flat belt, additional protective measures must be taken to prevent the motor from becoming destroyed since the toothed belt cannot slip under normal conditions.

For this purpose, many known motor protective switches can be utilized. However, these switches are very expensive and, at the onset of the blocked condition, cannot prevent the toothed belt from being intensely loaded for a certain length of time depending upon the switching speed of the switches.

SUMMARY OF THE INVENTION

It is therefore an object of the invention to provide a coupling which is simple to produce and replace. It is a further object of the invention to provide a replaceable brush assembly which includes a coupling that responds to a blocked condition and prevents destruction of the motor.

The replaceable brush assembly of the invention is suitable for floor cleaning devices such as an electric carpet sweeper and the like. The replaceable brush assembly includes a tubular brush defining an elongated opening for accommodating the output shaft of the cleaning device therein when the brush assembly is placed on the shaft. Ring-shaped cavity means is formed in the tubular brush in surrounding relation to the shaft; and, coupling-decoupling means is arranged in the cavity means for coupling the tubular brush to the shaft during normal operation of the floor cleaning device and for decoupling the tubular brush in response to an overload condition applied to the latter.

The tubular brush includes an annular body concentric with the shaft and has an outer end face. The coupling-decoupling means then includes: a slot formed in the end face of the shaft and the ring-shaped cavity means can be a bore formed in the end face of the annular body concentric with the elongated opening. The bore defines a ring-shaped wall in surrounding relationship to the slot; and, an S-shaped spring is arranged in the bore and has two arms connected to each other by a straight segment seated in the slot when the brush assembly is mounted on the shaft. The two arms bear resiliently against the ring-shaped wall so that the spring transmits torque from the shaft to the tubular brush.

It is preferable if the inner wall of the ring-shaped cavity includes recesses in which bent-out portions of the arms of the spring can engage.

The invention provides the decisive advantage that a simple overload coupling is provided in the context of a replaceable brush assembly which is simple to produce and which can be easily replaced.

BRIEF DESCRIPTION OF THE DRAWING

The invention will now be described with reference to the drawing wherein.

DESCRIPTION OF THE PREFERRED EMBODIMENTS OF THE INVENTION

Figures 1, 2:
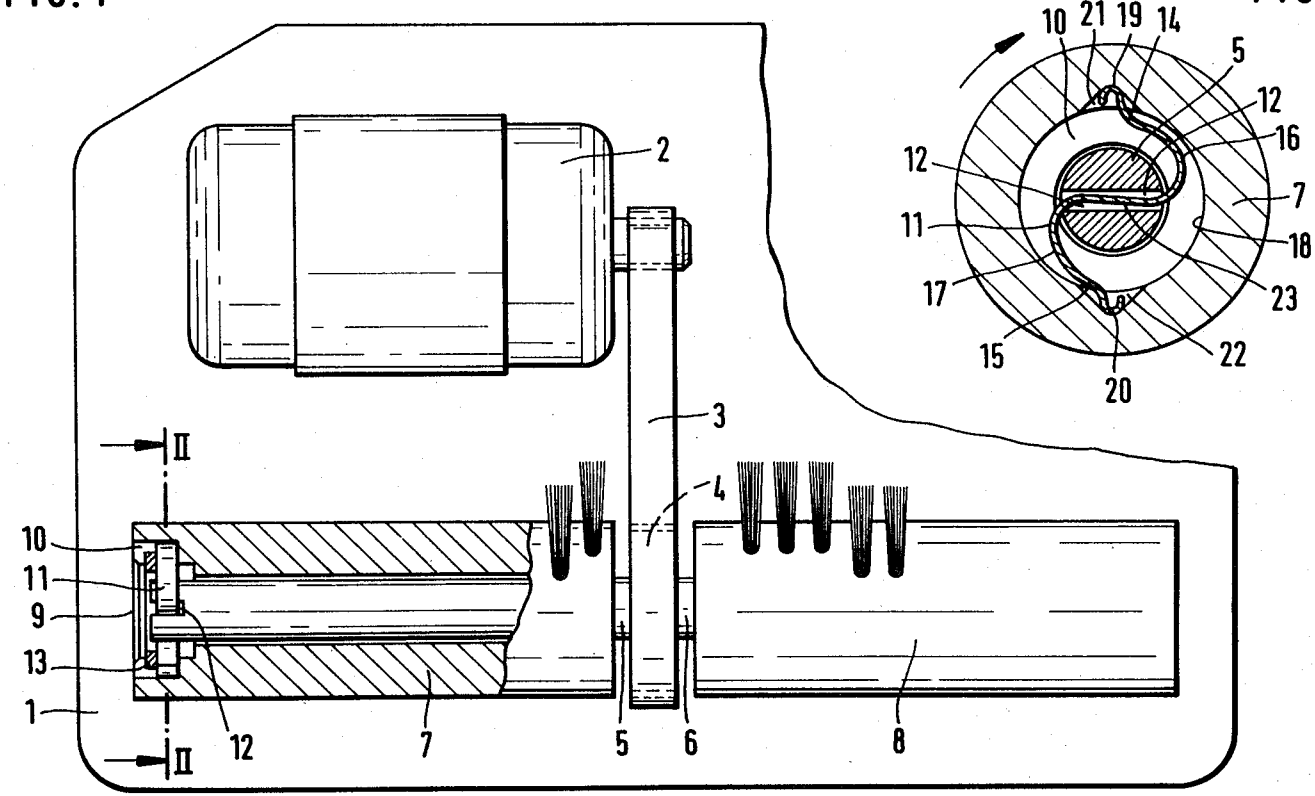
FIG. 1 is a schematic of an electric carpet sweeper having two brushes wherein one brush is broken out to show the overload coupling; and, FIG. 2 is a section view taken along line II—II of FIG. 1 to show a side elevation view of the coupling.

Referring to FIG. 1, reference numeral 1 identifies a housing of an electric carpet sweeper. An electric motor 2 is mounted in the housing and drives a toothed wheel 4 by means of a toothed belt 3. The toothed wheel 4 is connected to the ends of shaft portions 5 and 6. Brushes 7 and 8 are pushed onto the shafts 5 and 6, respectively, from the side. The brush 7 is shown partially in section to provide a view of the other end of shaft portion 5. The brush 7 is provided with a ring-shaped cavity 10 formed in the end face thereof.

A spring 11 bent to have an S-shape is mounted in the cavity 10 as shown also in FIG. 2. The spring 11 engages a slot 10 formed in the end face of the shaft portion 5. A securing ring 13 secures the spring 11 so that it is not pressed toward the front when the brush assembly is pushed onto the end of shaft portion 5.

Referring to FIG. 2, the brush 7 is pushed over the shaft 5 so that the slot 12 is disposed in the ring-shaped space 10.

The S-shaped spring 11 is mounted in the cavity 10. The S-shaped spring 11 has end portions 14 and 15 on respective arms 16 and 17 which brace against the inner wall of cavity 10. The end portions 14, 15 of the spring 11 have respective bent-out portions 19, 20 which engage in recesses 21, 22 of the inner wall 18 of the ring-shaped cavity 10. The straight portion 23 between the arms 16 and 17 becomes lodged in the slot 12 when the brush 7 is pushed over the shaft portion 5. When placing a brush 7 on a shaft, it is sometimes necessary to rotate the same back and forth somewhat to ensure that the straight portion 23 of the spring seats in the slot 12.

If the shaft portion 5 is driven in the direction of the arrow, the brush 7 will likewise be rotated therewith by the force of the resilient arms 16 and 17 lying with their respective ends 19 and 20 in recesses 21 and 22.

If the brush 7 becomes blocked, the shaft portion 5 will continue to rotate and the arms 16 and 17 will become dislodged from the recesses 21 and 22 and will be pressed in a direction toward the longitudinal axis of the shaft portion 5. The arms 16 and 17 will then slide along the inner wall 18 and will engage the mutually adjacent recesses 21 and 22 and again be dislodged therefrom and be pressed toward the shaft. In this way a ratcheting noise occurs in the decoupled condition which provides an additional indication of trouble.

It is a very substantial advantage that the portions of the coupling which are subjected to wear, namely, the spring 11 and the inner wall 18 are replaced when the brush 7 is replaced.

It is understood that the foregoing description is that of the preferred embodiments of the invention and that various changes and modifications may be made thereto without departing from the spirit and scope of the invention as defined in the appended claims.

What is claimed is:

1. A replaceable brush assembly for a floor cleaning device such as an electric carpet sweeper having a drive for rotatably driving a shaft for receiving the replaceable brush assembly thereon, the replaceable brush assembly comprising:

a tubular brush defining an elongated opening for accommodating the shaft therein when the brush assembly is placed thereon;

ring-shaped cavity means formed in said tubular brush in surrounding relation to said shaft; and, coupling-decoupling means arranged in said cavity means for coupling said tubular brush to said shaft during normal operation of the floor cleaning device and for decoupling said tubular brush in response to an overload condition applied to the latter.

2. The replaceable brush assembly of claim 1, said tubular brush including an annular body concentric with said shaft and having an outer end face; and, said coupling-decoupling means comprising:

a slot formed in the end face of said shaft;

said ring-shaped cavity means being a bore formed in said end face of said annular body concentric with said elongated opening;

said bore defining a ring-shaped wall in surrounding relationship to said slot; and, an S-shaped spring arranged in said cavity means and having two arms connected to each other by a straight segment seated in said slot when the brush assembly is mounted on said shaft, said two arms bearing resiliently against said ring-shaped wall for transmitting torque via said spring from said shaft to said tubular brush.

3. The replaceable brush assembly of claim 2, said coupling-decoupling means further comprising: two recess means formed in said ring-shaped wall; and, said two arms having bent-out end portions resiliently biased in engaging contact with said two recess means thereby coupling said tubular brush assembly to said shaft during normal operation of said device and said bent-out portions becoming dislodged from said two recess means in response to said overload condition thereby decoupling said tubular brush from said shaft.

4. A floor cleaning device such as an electric carpet sweeper comprising:

a motor;

an output shaft;

non-slip torque transmission means for transmitting the output of said motor to said output shaft; and, a replaceable brush assembly including: a tubular brush defining an elongated opening for accommodating the shaft therein when the brush assembly is placed thereon; ring-shaped cavity means formed in said tubular brush in surrounding relation to said shaft; and, coupling-decoupling means arranged in said cavity means for coupling said tubular brush to said shaft during normal operation of the floor cleaning device and for decoupling said tubular brush in response to an overload condition applied to the latter.

5. The floor cleaning device of claim 4, said tubular brush including an annular body concentric with said shaft and having an outer end face;

a slot formed in the end face of said shaft;

said ring-shaped cavity means being a bore formed in said end face of said annular body concentric with said elongated opening;

said bore defining a ring-shaped wall in surrounding relationship to said slot; and, an S-shaped spring arranged in said cavity means and having two arms connected to each other by a straight segment seated in said slot when the brush assembly is mounted on said shaft, said two arms bearing resiliently against said ring-shaped wall for transmitting torque via said spring from said shaft to said tubular brush.

6. The floor cleaning device of claim 5, said coupling-decoupling means further comprising: two recess means formed in said ring-shaped wall; and, said two arms having bent-out end portions resiliently biased in engaging contact with said two recess means thereby coupling said tubular brush assembly to said shaft during normal operation of said device and said bent-out portions becoming dislodged from said two recess means in response to said overload condition thereby decoupling said tubular brush from said shaft.

7. A floor cleaning device such as an electric carpet sweeper comprising:

a motor;

an output shaft;

non-slip torque transmission means for transmitting the output of said motor to said output shaft at the center thereof;

said output shaft having lefthand and righthand shaft portions on respective sides of said transmission means;

two replaceable brush assemblies corresponding to respective ones of said shaft portions;

each one of said replaceable brush assemblies including: a tubular brush defining an elongated opening for accommodating the shaft portion therein when the brush assembly is placed thereon; ring-shaped cavity means formed in said tubular brush in surrounding relation to said shaft portion; and, coupling-decoupling means arranged in said cavity means for coupling said tubular brush to said shaft during normal operation of the floor cleaning device and for decoupling said tubular brush in response to an overload condition applied to the latter.

8. The floor cleaning device of claim 7, said non-slip torque transmission means comprising: a toothed wheel mounted on said output shaft; and, a toothed belt for transmitting the output of said motor to said output shaft.

* * * * *